US008401450B2

(12) United States Patent
Sekihara et al.

(10) Patent No.: US 8,401,450 B2
(45) Date of Patent: Mar. 19, 2013

(54) PRESSING MEMBER AND IMAGE HEATING MEMBER USING THE PRESSING MEMBER

(75) Inventors: Yuko Sekihara, Tokyo (JP); Norio Hashimoto, Odawara (JP); Hiroaki Sakai, Mishima (JP); Hiroyuki Sakakibara, Yokohama (JP); Kazuo Kishino, Yokohama (JP); Masaaki Takahashi, Yokohama (JP); Katsuhisa Matsunaka, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 218 days.

(21) Appl. No.: 12/904,783

(22) Filed: Oct. 14, 2010

(65) Prior Publication Data

US 2011/0091252 A1 Apr. 21, 2011

(30) Foreign Application Priority Data

Oct. 19, 2009 (JP) ..... 2009-240324

(51) Int. Cl.
*G03G 15/20* (2006.01)

(52) U.S. Cl. ..... 399/333; 399/280; 399/320

(58) Field of Classification Search ..... None
See application file for complete search history.

(56) References Cited

U.S. PATENT DOCUMENTS

| | | | | |
|---|---|---|---|---|
| 7,193,181 | B2 | 3/2007 | Makihira et al. | |
| 7,215,916 | B2 | 5/2007 | Kishino et al. | |
| 7,283,145 | B2 | 10/2007 | Kato et al. | |
| 7,321,746 | B2 | 1/2008 | Sakakibara et al. | |
| 7,366,455 | B2 | 4/2008 | Iwasaki et al. | |
| 7,457,577 | B2 * | 11/2008 | Matsunaka et al. | 399/333 |
| 7,514,021 | B2 * | 4/2009 | Miyagawa et al. | 252/500 |
| 7,558,519 | B2 | 7/2009 | Jinzai et al. | |
| 7,734,241 | B2 | 6/2010 | Nishida et al. | |
| 2005/0214044 | A1 * | 9/2005 | Sakakibara et al. | 399/333 |
| 2009/0003902 | A1 | 1/2009 | Sakakibara et al. | |
| 2009/0116886 | A1 | 5/2009 | Sakai et al. | |
| 2009/0117303 | A1 | 5/2009 | Goshiki | |
| 2010/0055365 | A1 | 3/2010 | Nakajima et al. | |
| 2010/0279045 | A1 | 11/2010 | Nakajima et al. | |

FOREIGN PATENT DOCUMENTS

| | | | |
|---|---|---|---|
| CN | 1673895 | A | 9/2005 |
| CN | 101069136 | A | 11/2007 |
| CN | 101369126 | A | 2/2009 |
| CN | 101522808 | A | 9/2009 |
| JP | 2007-101736 | A | 4/2007 |
| JP | 2007-167477 | A | 7/2007 |
| TW | 200927834 | A | 7/2009 |

OTHER PUBLICATIONS

Chinese Office Action dated Aug. 8, 2012, issued in counterpart Chinese Application No. 201010516242.8, and English-language translation thereof.

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

A pressing member for creating a nip in which the pressing member contacts a heating member and a recording material is heated while being nip-conveyed, includes an elastic layer and a high thermal conductive elastic layer, which is provided on the elastic layer and has a thermal conductivity which is higher than that of the elastic layer. In the high thermal conductive elastic layer, carbon fibers and carbon nanofibers are dispersed in a heat-resistant elastic material.

14 Claims, 4 Drawing Sheets

(a)

(b)

PRESSING MEMBER AND IMAGE HEATING MEMBER USING THE PRESSING MEMBER

FIELD OF THE INVENTION AND RELATED ART

The present invention relates to a pressing member suitable for use as a pressing roller of a fixing apparatus (fixing device) to be mounted in an image forming apparatus such as an electrophotographic copying machine or an electrophotographic printer and relates to an image heating apparatus using the pressing member.

As the fixing apparatus (fixing device) to be mounted in the electrophotographic printer or copying machine, there is a fixing device of a heating-roller type including a halogen heater, a fixing roller to be heated by the halogen heater, and a pressing roller (pressing member) for creating a nip in contact with the fixing roller. Further, as the fixing device, there is a fixing device of a film-heating type including a heater which includes a ceramic substrate and a heat generating resistor provided on the ceramic substrate, a fixing film movable in contact with the heater, and a pressing roller (pressing member) for creating a nip between itself and the fixing film which contacts the heater. Both of the fixing devices of the heating-roller type and the film-heating type heat-fix a toner image on a recording material while nip-conveying the recording material, on which an unfixed toner image is carried, in the nip. When a small-sized recording material is subjected to continuous printing at the same print interval as that for a large-sized recording material by using a printer in which the fixing device of the heating-roller type is mounted, it has been known that, on the fixing roller, an area (non-sheet-passing portion) through which the recording material does not pass is excessively increased in temperature (hereinafter referred to as the non-sheet-passing portion temperature rise). Further, when the small-fixed recording material is subjected to continuous printing at the same printer interval as that for the large-sized recording material by using a printer in which the fixing device of the film-heating type is mounted, it has been known that the non-sheet-passing portion temperature rise occurs on the heater.

This non-sheet-passing portion temperature rise is liable to occur with a higher processing speed (process speed) of the printer. This is because a fixing temperature necessary to heat-fix the toner image on the recording material is increased in many cases since a time period in which the recording material passes through the nip is decreased with a speed-up in processing speed. When such non-sheet-passing portion temperature rise occurs, there is a possibility that parts constituting the fixing device are damaged. Further, in a state in which the non-sheet-passing portion temperature rise occurs, when the large-sized recording material is subjected to the printing, toner is excessively melted on the recording material at a portion corresponding to the non-sheet-passing portion to cause an occurrence of high-temperature offset. In order to prevent the above-described problems from arising, as one of means for reducing a degree of the non-sheet-passing portion temperature rise, a method in which thermal conductivity of the pressing roller is increased has been generally known. This method can achieve such an effect that a heat transfer property of an elastic layer of the pressing roller is positively improved to reduce the degree of the non-sheet-passing portion temperature rise, i.e., to reduce a level difference in heat of the fixing roller or the heater with respect to a longitudinal direction of the fixing roller or the heater. Japanese Patent Application No. 2007-167477 discloses a pressing roller having an elastic layer and a high thermal conductive elastic layer in which pitch-based carbon fibers are dispersed. With respect to this pressing roller, the thermal conductivity of the high thermal conductive elastic layer with respect to the longitudinal direction is higher than that of the elastic layer, so that the pressing roller is effective in alleviating the non-sheet-passing portion temperature rise.

The pressing roller disclosed in Japanese Patent Application No. 2007-167477 was able to well alleviate the non-sheet-passing portion temperature rise but an addition amount of the pitch-based carbon fibers had an upper limit of 40 vol. %.

SUMMARY OF THE INVENTION

A principal object of the present invention is to provide a pressing member which includes a high thermal conductive elastic layer and an elastic layer and is capable of increasing the thermal conductivity of the high thermal conductive elastic layer with respect to a longitudinal direction of the high thermal conductive elastic layer without increasing the total amount of a thermal conductive filler dispersed in the high thermal conductive elastic layer.

Another object of the present invention is to provide an image heating apparatus including the pressing member.

A further object of the present invention is to provide an image forming apparatus including the image heating apparatus.

According to an aspect of the present invention, there is provided a pressing member for creating a nip in which the pressing member contacts a heating member and a recording material is heated while being nip-conveyed, the pressing member comprising:

an elastic layer; and a high thermal conductive elastic layer which is provided on the elastic layer and has a thermal conductivity which is higher than that of the elastic layer, wherein in the high thermal conductive elastic layer, a needle-like thermal conductivity-anisotropic filler and carbon nanofibers are dispersed in a heat-resistant elastic material.

According to another aspect of the present invention, there is provided an image heating apparatus comprising:

a heating member; and a pressing member, including an elastic layer and a high thermal conductive elastic layer which is provided on the elastic layer and has a thermal conductivity which is higher than that of the elastic layer, for creating a nip in contact with the heating member, wherein in the high thermal conductive elastic layer, a needle-like thermal conductivity-anisotropic filler and carbon nanofibers are dispersed in a heat-resistant elastic material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

General Structure of Image Forming Apparatus

Figure 1:
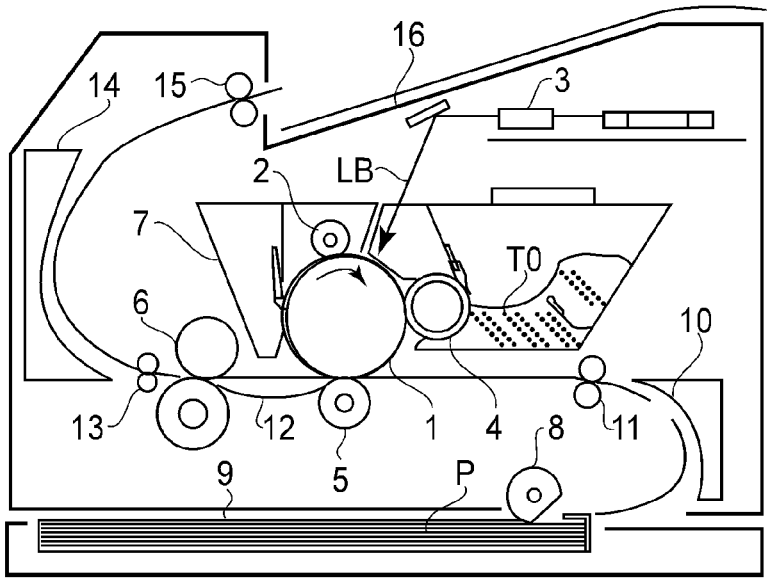
FIG. 1(*a*) is a schematic structural view of an example of an image forming apparatus, and FIG. 1(*b*) is a schematic cross-sectional side structural view of a fixing device (fixing apparatus).
Figure 1:
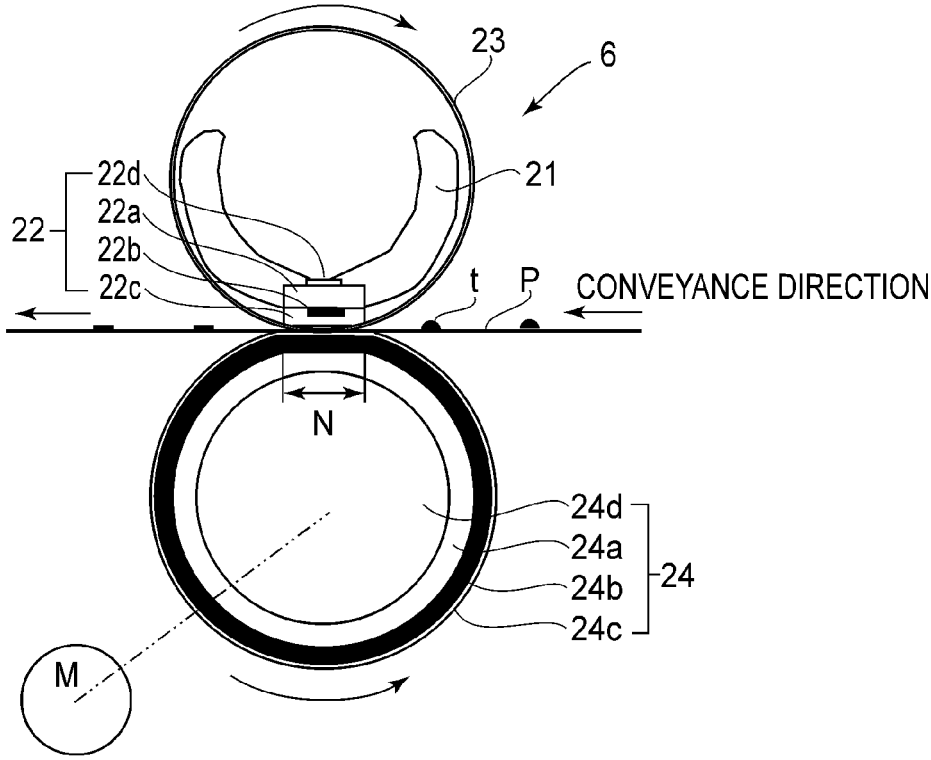

FIG. 1(*a*) is a schematic structural view of an example of an image forming apparatus in which an image heating apparatus according to the present invention is mounted as a fixing apparatus (fixing device). This image forming apparatus is a laser beam printer of an electrophotographic type. The printer in this embodiment includes a rotatable drum-type electrophotographic photosensitive member (hereinafter referred to as a photosensitive drum) 1 as an image bearing member. The photosensitive drum 1 is constituted by forming a photosensitive material layer of an OPC (organic photoconductor), amorphous Se (selenium), amorphous Si (silicon), or the like on an outer circumferential surface of a cylinder (drum)-like electroconductive support of aluminum, nickel, or the like. The photosensitive drum 1 is rotated in an arrow direction at a predetermined peripheral speed (process speed) in accordance with a print instruction. During this rotation, the outer circumferential surface of the photosensitive drum 1 is uniformly charged to a predetermined polarity and a predetermined potential by a charging roller 2 as a charging means. The uniformly charged surface of the photosensitive drum 1 is subjected to scanning exposure with a laser beam LB which has been output from a laser beam scanner 3 and modulation-controlled (ON/OFF controlled) depending on image information. As a result, an objective electrostatic latent image depending on the image information is formed on the surface of the photosensitive drum 1. This latent image is developed with toner TO by a developing device 4 as a developing means, thus being visualized as a toner image. As a developing method, a jumping developing method, a two-component developing method, a FEED (floating electrode effect developing) method, and the like are used. These methods are frequently used in combination with image exposure and reverse development.

On the other hand, a recording material P stacked and accommodated in a feeding cassette 9 is fed one by one by driving a feeding roller 8 and passes through a sheet path including a guide 10 and then is conveyed to registration rollers 11. The registration rollers 11 feed the recording material P into a transfer nip between the surface of the photosensitive drum 1 and the outer circumferential surface of a transfer roller 5 with a predetermined control timing. The recording material P is nip-conveyed in the transfer nip and during this conveyance process. Toner images are successively transferred from the surface of the photosensitive drum 1 onto the surface of the recording material P by a transfer bias applied to the transfer roller 5. As a result, the recording material P carries unfixed toner images (unfixed images). The recording material P carrying the unfixed toner images is successively separated from the surface of the photosensitive drum 1 and is discharged from the transfer nip and then is introduced into a nip of a fixing device (apparatus) 6 through a conveying guide 12.

The recording material P is subjected to heat and pressure in the nip of the fixing device 6, so that the toner images are fixed on the surface of the recording material P. The recording material P which comes out of the fixing device 6 passes through a sheet path including conveying rollers 13, a guide 14 and discharging rollers 15 and then is discharged on a discharging tray 16 as a printout. Further, the surface of the photosensitive drum 1 after the recording material P is separated therefrom is subjected to removal of a deposition contaminant, such as residual toner, by a cleaning device 7 as a cleaning means, thus being cleaned and then being subjected to image formation repetitively. The printer in this embodiment can handle A3-sized paper and has a print speed of 50 sheets/minute (A4 landscape). The toner which principally contained a styrene-acrylic resin material and in which a charge control agent, a magnetic material, silica and the like were internally or externally added to the styrene-acrylic resin material to have a glass transition point of 55-65° C. was used.

(Fixing Device)

In the following description, with respect to the fixing device and members constituting the fixing device, a longitudinal direction is a direction perpendicular to a recording-material conveyance direction in a plane of the recording material. A widthwise direction is a direction parallel to the recording-material conveyance direction in the recording-material plane. A width is a dimension with respect to the widthwise direction. FIG. 1(*b*) is a schematic cross-sectional side structural view of the fixing device 6.

The fixing device 6 is of the film-heating type. A film guide 21 is formed in a tub-like shape having a substantially arcuate cross section. The film guide 21 is an elongated member with respect to the longitudinal direction, which is a direction perpendicular to the drawing. A heating element 22 is accommodated in and supported by a groove formed along the longitudinal direction at a substantially central portion on a lower surface of the film guide 21. A heat-resistant film 23 as a flexible measure (hereinafter referred to as a fixing film) is formed in an endless belt-like (cylinder-like) shape which is long with respect to the longitudinal direction. The fixing film 23 is loosely engaged externally with the film guide 21 by which the heating element 22 is supported. As a material for the film guide 21, a molded product of heat-resistant resin such as PPS (polyphenylene sulfide) or a liquid crystalline polymer is used. The heating element 22 is a ceramic heater which has low thermal capacity on the whole and is elongated in the longitudinal direction. The heater 22 includes a thin plate-like alumina heater substrate 22*a*, which is elongated in the longitudinal direction. Further, on a surface (a nip-side surface described later) of the heater substrate 22*a*, an electric heat generating element (heat generating resistor) 22*b*, which is linear in form or has a fine strip-like shape and is made of Ag/Pd or the like and extends along the longitudinal direction, is formed. The electric heat generating element 22*b* is protected by a surface protective layer 22*c* formed with a thin glass layer or the like so as to cover the electric heat generating element 22*b*.

On a back surface (opposite from the nip-side surface) of the heater substrate 22*a*, a temperature sensing element 22*d*, such as a thermistor as a temperature detecting measurement, is provided. The fixing film 23 is a composite layer film prepared by coating a parting layer on the surface of a base film so as to have a total thickness of not more than 100 μm, preferably not more than 60 μm and not less than 20 μm. As a material for the base film, a resin material such as PI (polyimide), PAI (polyamide imide), PEEK (polyether ether ketone), or PES (polyether sulfone) and a metal material such as SUS or Ni may be used. As a material for the parting layer, a fluorine-containing resin material such as PTFE (polytetrafluoroethylene), PFA (tetrafluoroethylene-perfluoroalkylvinylether-copolymer), or FEP (tetrafluoroethylene-hexafluoroethylene-copolymer) may be used.

A pressing roller 24, as a pressing member, is formed in a roller shape extending in the longitudinal direction. The pressing roller 24 includes a metal core 24*d* which is formed of a material such as iron or aluminum in an elongated round shaft shape with respect to the longitudinal direction. An elastic layer (heat-resistant rubber layer) 24*a* is provided on the outer circumferential surface of the metal core 24*d* between portions to be supported which are provided at longitudinal end portions of the metal core 24*d*. On the outer circumferential surface of the elastic layer 24*a*, a high thermal conductive elastic layer 24*b*, which has a higher thermal conductivity than the elastic layer 24*a*. Further, on the outer circumferential surface of the high thermal conductive elastic layer 24*b*, a parting layer 24*c* is provided.

The pressing roller 24 is disposed under the fixing film 23 so as to oppose the fixing film 23. The pressing roller 24 is pressed against the fixing film 23 toward the surface protective layer 22*c* of the heater 22 with a predetermined pressure by a predetermined pressing mechanism (not shown). Depending on the pressure, the outer circumferential surface of the pressing roller 24 and the outer circumferential surface of the fixing film 23 contact each other, so that the elastic layer 24*a* and the high thermal conductive elastic layer 24*b* are elastically deformed. As a result, the nip N (transfer nip) having a predetermined width is created between the surface of the pressing roller 24 and the surface of the fixing film 23.

(Heat-Fixing Operation of Fixing Device)

In accordance with the print instruction, when a fixing motor M as a driving source is rotationally driven, a rotational force of this fixing motor M is transmitted to the pressing roller 24 through a power transmitting mechanism (not shown). As a result, the pressing roller 24 is rotated in a direction indicated by an arrow at a predetermined peripheral speed (process speed). The rotational force of the pressing roller 24 is transmitted to the surface of the fixing film 23 through the nip N, so that the fixing film 23 is rotated in a direction indicated by an arrow by the rotation of the pressing roller 24. Further, when electric power is supplied from an electric power control portion (not shown) to the electric heat generating element 22*b* of the heater 22 in accordance with the print instruction, the electric heat generating element 22*b* generates heat, so that the heater 22 is quickly increased in temperature. The temperature of the heater 22 is detected by the temperature sensing element 22*d* and on the basis of an output signal of the temperature sensing element 22*d*, the electric power control portion controls the supply of electric power to the electric heat generating element 22*b* so that the temperature of the heater 22 is kept at a predetermined fixing temperature (target temperature). In a state in which the fixing motor M is rotationally driven and the electric power supply to the electric heat generating element 22*b* of the heater 22 is controlled, the recording material P on which an unfixed toner image t is carried is introduced into the nip N. This recording material P is nip-conveyed in the nip N in the electric power supply-controlled state while being nipped between the fixing film 23 surface and the pressing roller 24 surface. Further, during this conveyance process, heat of the heater 22 is applied to the toner image t through the fixing film 23 and at the same time the pressure is applied to the toner image t in the nip N, so that the toner image t is heat-fixed on the recording material P.

(Elastic Layer and High Thermal Conductive Elastic Layer of Pressing Roller)

A total thickness of the entire elastic layer (24*a*+24*b*) obtained by adding the thickness of the elastic layer 24*a* and the thickness of the high thermal conductive elastic layer 24*b* is not particularly limited so long as the total thickness can permit creation of the nip N having the predetermined width but may preferably be not less than 2 mm and not more than 10 mm. The thickness of the elastic layer 24*a* is not particularly limited but may appropriately be adjusted to a necessary thickness depending on the hardness of the high thermal conductive elastic layer. As a material for the elastic layer 24*a*, it is possible to use a general heat-resistant solid rubber such as silicone rubber. The heat-resistant solid rubber is suitable as a principal material for the elastic layer 24*a* since it has a sufficient heat resistivity and preferable elasticity (softness) in the case where it is used as the material for the elastic layer 24*a* of the pressing roller 24.

A forming method of the elastic layer 24*a* is not particularly limited but it is possible to suitably use a general molding method or a general coating method. The high thermal conductive elastic layer 24*b* is formed on the outer circumferential surface of the elastic layer 24*a* in a uniform thickness. The forming method of the high thermal conductive elastic layer 24*a* is also not particularly limited but it is possible to generally use the forming method such as the molding method or the coating method. The thickness of the high thermal conductive elastic layer 24*b* can be appropriately adjusted depending on the thickness of the elastic layer 24*a* when the thickness of the entire elastic layer (24*a*+24*b*) is in the range from 2 mm to 10 mm. It is essential that the high thermal conductive elastic layer 24*b* is formed by dispersing carbon fibers 24*f* as a needle-like thermal conductivity-anisotropic filler and carbon nanofibers 24*g* in a heat-resistant elastic material 24*e*.

Figure 2:
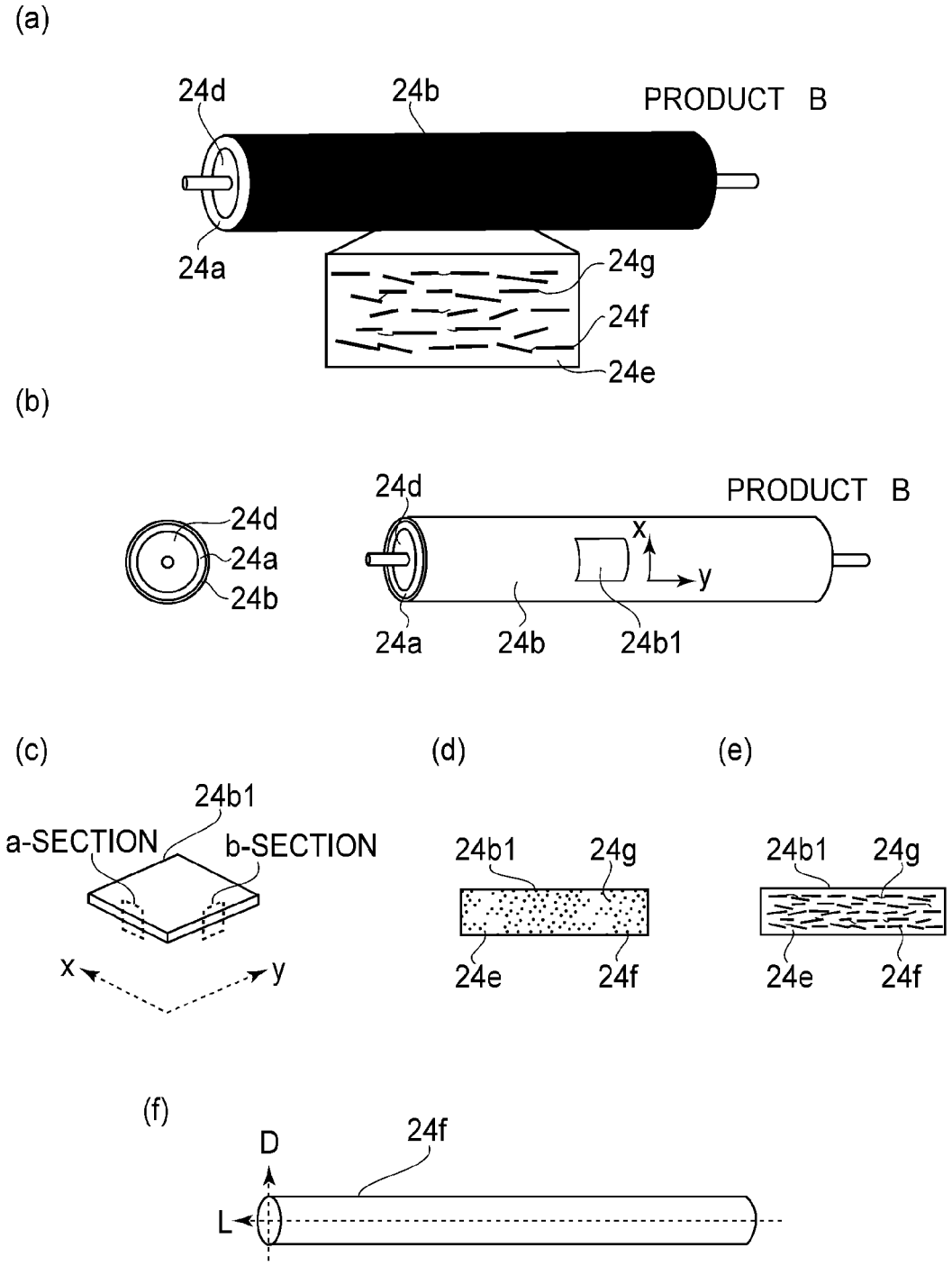
FIG. 2(*a*) is an illustration of an elastic layer-formed product which is prepared during a manufacturing process of a pressing roller, FIG. 2(*b*) includes a perspective view of an outer appearance of the elastic layer-formed product and a side view thereof as seen from an end portion of the elastic layer-formed product with respect to a longitudinal direction of the elastic layer-formed product, FIG. 2(*c*) is an enlarged perspective view of a sample of a high thermal conductive elastic layer cut away from the elastic layer-formed product shown in FIG. 2(*b*), FIG. 2(*d*) and FIG. 2(*e*) are enlarged views of a-section and b-section, respectively, of the cut sample of the high thermal conductive elastic layer shown in FIG. 2(*c*), and FIG. 2(*f*) is an illustration showing a fiber diameter portion and a fiber length portion of a carbon fiber contained in the high thermal conductive elastic layer.

In the following description, a roller-like member prepared during a manufacturing process of the pressing roller 24, i.e., the roller-like member including the metal core 24*d*, the elastic layer 24*a* provided on the outer circumferential surface of the metal core 24*d*, and the high thermal conductive elastic layer 24*b* provided on the outer circumferential surface of the elastic layer 24*a*, is referred to as an elastic layer-formed product B (FIG. 2(*b*)). FIG. 2(*a*) is an illustration of the elastic layer-formed product B prepared during the manufacturing process of the pressing roller 24.

As the heat-resistant elastic material 24*e*, similarly as in the case of the elastic layer 24*a*, the heat-resistant rubber material, such as the silicone rubber or the fluorine-containing rubber, can be used. In the case of using the silicone rubber as the heat-resistant elastic material 24*e*, an additive silicone rubber may preferably be used from the viewpoints of availability and easy processing. Incidentally, before the additive silicone rubber is cured, liquid dripping occurs during processing of the additive silicone rubber by the coating method when a viscosity of the additive silicone rubber is excessively low, and it is difficult to mix and disperse the additive silicone rubber when the viscosity of the additive silicone rubber is excessively high. For this reason, a raw silicone rubber having the viscosity of about 0.1 Pa·s to about 1000 Pa·s may preferably be used. The carbon fibers 24*f* and the carbon nanofibers 24*g* have the function as a filler for ensuring the thermal conductivity of the high thermal conductive elastic layer 24*b*. By dispersing the carbon fibers 24*f* and the carbon nanofibers 24*g* in the heat-resistant elastic material 24*e*, a heat flow path can be increased in the high thermal conductive elastic layer 24*b*. As a result, it becomes possible to efficiently disperse the heat from a high temperature portion such as a non-sheet-passing portion through which the recording material P does not pass on the pressing roller 24 to a sheet passing portion through which the recording material P passes.

Further, the carbon fibers 24*f* have a fiber shape (needle-like shape), so that when the carbon fibers 24*f* are kneaded in the heat-resistant elastic material 24*e* in a liquid state before the curing, the carbon fibers 24*f* are liable to be aligned (oriented) in a direction of flow of the liquid heat-resistant elastic material 24*e* at the time of molding (forming) the high thermal conductive elastic layer 24*b*. That is, when the molding of the high thermal conductive elastic layer 24*b* is performed by flowing the liquid high thermal conductive elastic layer 24*b*, in which the carbon fibers 24*f* are kneaded, from one end side to the other end side on the elastic layer 24*a* with respect to the longitudinal direction of the elastic layer 24*a*, the carbon fibers 24*f* are liable to be aligned along the longitudinal direction of the elastic layer 24*a*. As a result, it is possible to enhance the thermal conductivity of the high thermal conductive elastic layer 24*b* with respect to the longitudinal direction. Further, the carbon nanofibers 24*g* have the fiber shape and a fiber diameter on the order of nanometers. For this reason, when the carbon nanofiber 24*g* are kneaded together with the carbon fibers 24*f* in the heat-resistant elastic material 24*e* in the liquid state before the curing, the carbon nanofibers 24*g* have the following function at the time of molding (forming) the high thermal conductive elastic layer 24*b*. That is, the molding of the high thermal conductive elastic layer 24*b* is performed by flowing the liquid high thermal conductive elastic layer 24*b*, in which the carbon nanofibers 24*g* are kneaded together with the carbon fibers 24*f*, from one end side to the other end side on the elastic layer 24*a* with respect to the longitudinal direction of the elastic layer 24*a*. In this case, the carbon nanofibers 24*g* have the function of connecting the carbon fibers 24*f* (thermal conductivity-anisotropic filler) to each other. As a result, it is possible to further enhance the thermal conductivity of the high thermal conductive elastic layer 24*b* with respect to the longitudinal direction.

Next, a state of the carbon fibers 24*f* and the carbon nanofibers 24*g* in the high thermal conductive elastic layer 24*b* after the curing will be described specifically. FIG. 2(*b*) includes a perspective view of an outer appearance of the elastic layer-formed product B and a side view thereof as seen from an end portion of the elastic layer-formed product B with respect to a longitudinal direction of the elastic layer-formed product B. FIG. 2(*c*) is an enlarged perspective view of a sample 24*b*1 of the high thermal conductive elastic layer 24*b* cut away from the elastic layer-formed product shown in FIG. 2(*b*). FIG. 2(*d*) and FIG. 2(*e*) are enlarged views of a-section and b-section, respectively, of the cut sample 24*b*1 of the high thermal conductive elastic layer 24*b* shown in FIG. 2(*c*). FIG. 2(*f*) is an illustration showing a fiber diameter portion D and a fiber length portion L of the carbon fiber 24*f* contained in the high thermal conductive elastic layer 24*b*.

As shown in FIG. 2(*b*), the high thermal conductive elastic layer 24*b* of the elastic layer-formed product B is cut in the x-direction (circumferential direction) and the y-direction (longitudinal direction) to obtain the cut sample 24*b*1 of the high thermal conductive elastic layer 24*b*. Then, as shown in FIG. 2(*c*), an a-section along the x-direction and a b-section along the y-direction of the cut sample 24*b*1 are observed. As a result, with respect to the a-section along the x-direction, as shown in FIG. 2(*d*), the fiber diameter portion D (FIG. 2(*b*)) of the carbon fibers 24*f* is principally observed. On the other hand, with respect to the b-section along the y-direction, the fiber length portion L (FIG. 2(*f*) of the carbon fibers 24*f* is observed in a large amount. Further, the carbon nanofibers 24*g* are observed among the carbon fibers 24*f* (FIG. 2(*e*)). Here, with respect to the carbon fibers 24*f*, when an average of fiber lengths of the fiber length portion (average fiber length) is shorter than 10 μm, a thermal conductivity anisotropic effect in the high thermal conductive elastic layer is less liable to be achieved. When the average fiber length is longer than 1 mm, it is difficult to perform dispersion processing molding of the carbon fibers 24*f* in the high thermal conductive elastic layer 24*b*. Therefore, the average fiber length of the carbon fibers 24*f* may preferably be not less than 0.01 mm and not more than 1 mm, more preferably not less than 0.05 mm and not more than 1 mm.

The carbon fibers 24*f* may preferably have a thermal conductivity $\lambda_f$ of 500 W/(m·k) ($\lambda_f \geqq 500$ W/(m·k)). The thermal conductivity $\lambda_f$ is measured by the laser-flash method (apparatus: laser-flash method thermal-constant measuring apparatus "TC-7000" (trade name), mfd. by ULVAC-RIKO Inc.). As the carbon fibers 24*f*, pitch-based carbon fiber which has been manufactured by using petroleum pitch or coal pitch as a starting material may preferably be used from the viewpoint of its high heat conductive performance. The carbon nanofibers 24*g* have an average of fiber diameters of the fiber diameter portion (average fiber diameter) which is not less than 50 nm and less than 1 μm, an average of fiber lengths of the fiber length portion (average fiber length) which is not more than 20 μm, and an aspect ratio (fiber length/fiber diameter) of not less than 20.

A lower limit of a total amount of the carbon fibers 24*f* and the carbon nanofibers 24*g* dispersed in the heat-resistant elastic material 24*e* is 5 vol. %. When the lower limit is below 5 vol. %, a value for an expected high heat conductive performance cannot be obtained. On the other hand, an upper limit of the total amount of the carbon fibers 24*f* and the carbon nanofibers 24*g* dispersed in the heat-resistant elastic material 24*e* is 30 vol. %. When the upper limit exceeds 30 vol. %, it is difficult to perform the molding the high thermal conductive elastic layer 24*b*. Therefore, the total amount of the carbon fibers 24*f* and the carbon nanofibers 24*g* is not less than 5 vol. % and not more than 30 vol. %. Here, a volume fraction of the carbon fibers 24*f* is obtained according to the following formula:

(volume of all carbon fibers contained in the high thermal conductive elastic layer)/[(volume of heat-resistant elastic material in the high thermal conductive elastic layer)+(volume of all carbon fibers contained in the high thermal conductive elastic layer)]×100 vol. %

Next, a measuring method of the thermal conductivity of the high thermal conductive elastic layer will be described.

Figure 3:
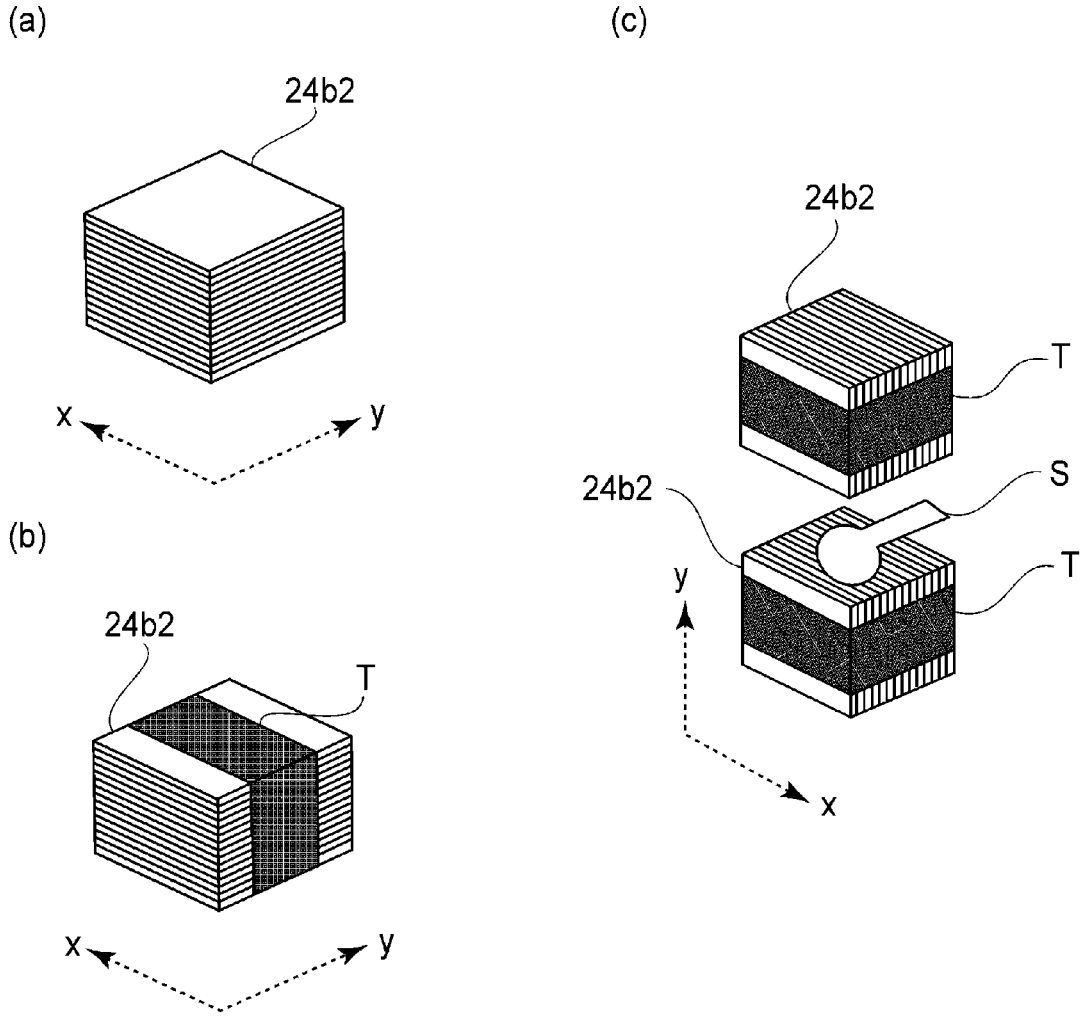
FIGS. 3(*a*) and 3(*b*) are illustrations each of a measurement sample (sample to be measured) for measuring a thermal conductivity of the high thermal conductive elastic layer, and FIG. 3(*c*) is an illustration of a method of measuring the thermal conductivity of the high thermal conductive elastic layer by using two measurement samples.

FIGS. 3(*a*) and 3(*b*) are illustrations each of a measurement sample (sample to be measured) for measuring a thermal conductivity of the high thermal conductive elastic layer 24*b*, and FIG. 3(*c*) is an illustration of a method of measuring the thermal conductivity of the high thermal conductive elastic layer 24*b* by using two measurement samples.

The thermal conductivity of the high thermal conductive elastic layer 24*b* with respect to the recording-material conveyance direction (circumferential direction: x-direction) and the direction (longitudinal direction: y-direction) perpendicular to the recording material conveyance direction can be measured by using a hot-disk method thermal property measuring apparatus ("TPA-501" (trade name), mfd. by KYOTO ELECTRONIC MANUFACTURING Co., Ltd.). In this case, in order to ensure a sufficient thickness to measure the thermal conductivity of the high thermal conductive elastic layer 24*b*, a measurement sample 24*b*2 is prepared by superposing a necessary number of cut samples 24*b*1 (FIG. 2(*c*)) cut away from the high thermal conductive elastic layer 24*b* in an appropriate manner. In this embodiment, a plurality of cut samples 24*b*1 each having an x-direction length of 15 mm, a y-direction length of 15 mm, and a thickness of a set value is cut away from the high thermal conductive elastic layer 24*b*. The thus-cut samples 24*b*1 are superposed so that the resultant thickness is about 15 mm to obtain the measurement sample 24*b*2 (FIG. 3(*a*)).

Then, the measurement sample 24*b*2 is fixed with a tape ("Kapton tape T") having a thickness of 0.07 mm and a width of 10 mm (FIG. 3(*b*)). Next, in order to uniformize flatness of the measurement sample 24*b*2 at a measurement surface, the measurement surface and a back surface opposite from the measurement surface are cut with a razor. Two sets of the measurement samples 24*b*2 are prepared, and a sensor S is sandwiched between these two sets of the measurement samples 24*b*2 to measure the thermal conductivity (FIG. 3(*c*)). In the case where the measurement samples 24*b*2 are subjected to the measurement with respect to a different direction α-direction, y-direction), the measurement direction is changed to a desired direction and then the measurement may be made in accordance with the above-described method. Incidentally, in this embodiment, an average of fine measured values was used.

(Parting Layer of Pressing Roller)

The parting layer 24*c* may be formed by covering the outer circumferential surface of the high thermal conductive elastic layer 24*b* with a PFA tube. Alternatively, the parting layer 24*c* may also be formed by coating the fluorine-containing resin material such as PTFE, PFA or FEP on the outer circumferential surface of the high thermal conductive elastic layer 24*b*. Incidentally, the thickness of the parting layer 24*c* is not particularly limited so long as the parting layer 24*c* can provide a sufficient parting property to the pressing roller 24. Further, between the high thermal conductive elastic layer 24*b* and the parting layer 24*c*, an adhesive layer may be formed for bonding purpose.

(Performance Evaluation of Pressing Roller)

Performances of pressing rollers prepared in Embodiments 1 to 6 and Comparative Embodiments 1 and 2 were evaluated. Each of the pressing rollers subjected to the performance evaluation has a constitution including the elastic layer 23*a* having an outer diameter of 30 mm and a thickness of 3.5 mm, the high thermal conductive elastic layer 24*b* having an thickness of 1.0 mm, and the parting layer 24*c* of a 50 μm-thick PFA tube as the surface layer. The pressing rollers are prepared by the same molding method. The pressing rollers are subjected to a performance comparison by changing only the composition of the carbon fibers and the carbon nanofibers in the high thermal conductive elastic layer 24*b*. First, the carbon fibers and the carbon nanofibers used in Embodiments 1 to 6 and Comparative Embodiments 1 and 2 are shown.

<Carbon Fiber>

(a) Pitch-Based Carbon Fiber (100-05M)

"XN-100-05M" (trade name), mfd. by Nippon Graphite Fiber Corp.

average fiber diameter: 9 μm average fiber length: 50 μm thermal conductivity: 900 W/(m·k)

(B) Pitch-Based Carbon Fiber (100-15M)

"XN-100-15M" (trade name), mfd. by Nippon Graphite Fiber Corp.

average fiber diameter: 9 μm average fiber length: 150 μm thermal conductivity: 900 W/(m·k)

<Carbon Nanofiber>

"VGCF-S" (trade name), mfd. by Showa Denko K.K.

average fiber diameter: 100 nm average fiber length: 10 μm

Figure 4:
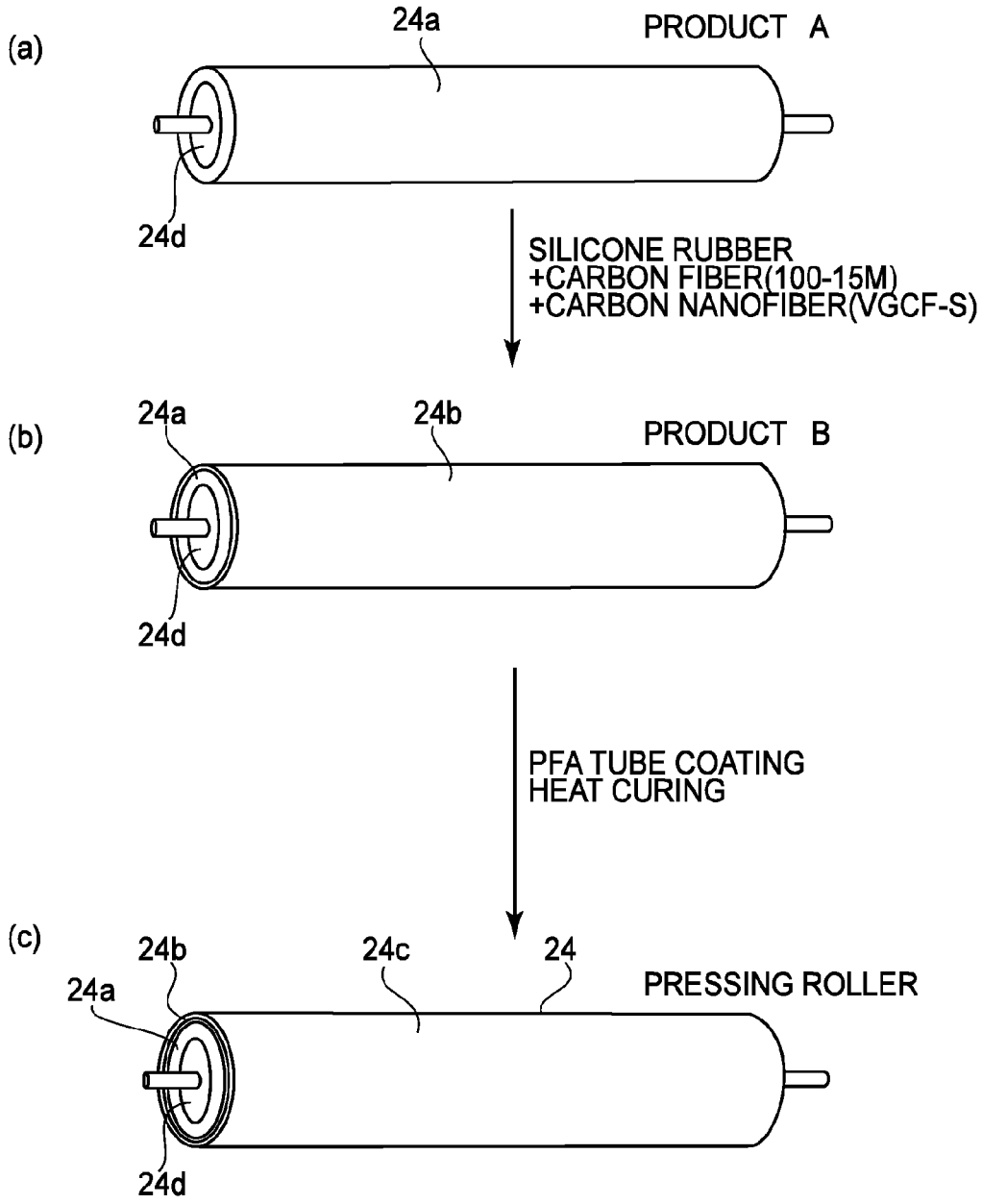
FIGS. 4(*a*), 4(*b*) and 4(*c*) are schematic views for illustrating a procedure of forming (molding) the pressing roller in Embodiments 1 to 6 and Comparative Embodiments 1 and 2.

Next, the molding method of the elastic layer 23*a* common to Embodiments 1 to 6 and Comparative Embodiments 1 and 2 will be described. FIGS. 4(*a*) to 4(*c*) are schematic views for illustrating a molding procedure of the pressing rollers in Embodiments 1 to 6 and Comparative Embodiments 1 and 2.

Referring to FIGS. 4(*a*) to 4(*c*), first, a 3.5 mm-thick elastic layer 24*a* is formed on the outer circumferential surface of a Al metal core 24*d* having a diameter of 22 mm by using an addition (reaction) curing silicone rubber having a density of 1.20 g/cm$^3$ to obtain a elastic layer-formed product A having a diameter of 29 mm (FIG. 4(*a*)). Here, the silicone rubber was heated and cured for 30 minutes under a temperature condition of 150° C. In Embodiments 1 to 4, a total amount of the carbon fibers 24*f* and the carbon nanofibers 24*g* in the high thermal conductive elastic layer 24*b* (hereinafter referred to as a total filler amount) is adjusted to 25 vol. % and then the molding of the high thermal conductive elastic layer 24*b* is performed. In Embodiment 5, the total filler amount is adjusted to 30 vol. % and then the molding of the high thermal conductive elastic layer 24*b* is performed. In Embodiment 6, the total filler amount is adjusted to 35 vol. % and then the molding of the high thermal conductive elastic layer 24*b* is performed. In Comparative Embodiments 1 and 2, the total filler amount is adjusted to 25 vol. % and then the molding of the high thermal conductive elastic layer 24*b* is performed. The pressing roller molding method in each of Embodiments 1 to 6 and Comparative Embodiments 1 and 2 will be described specifically.

Embodiment 1

First, an addition curing silicone rubber stock liquid (raw liquid) was obtained by mixing liquid A and liquid B shown below in a ratio of 1:1 and then by adding a platinum compound to the resultant mixture.

Liquid A: vinyl group concentration (0.863 mol. %, SiH concentration (zero mol. %), viscosity (7.8 Pa·s)

Liquid B: vinyl group concentration (0.955 mol. %, SiH concentration (0.780 mol. %), viscosity (6.2 Pa·s)

H/Vi (A/B=1/1)=0.43 weight-average molecular weight (Mw)=65,000 number-average molecular weight (Mn)=15,000

A silicone rubber composition 1 was obtained by uniformly mixing and kneading 24.5 vol. % of pitch-based carbon fiber (100-15M) and 0.5 vol. % of carbon nanofiber (VGCF-S) per a total of the amount of the silicone rubber stock liquid and the total filler amount.

Next, the elastic layer-formed product A having the diameter of 29 mm was set in a metal mold having a diameter of 30 mm so that their (one) axes coincide with each other. Then, between the metal mold and the elastic layer-formed product A, the above-prepared silicone rubber composition 1 was injected and was subjected to heat curing at 150° C. for 60 minutes to obtain an elastic layer-formed product B which included the high thermal conductive elastic layer 24*b* and had a diameter of 30 mm (FIG. 4(*b*)). Further, a 50 μm-thick PFA tube was coated on the outer circumferential surface of the elastic layer-formed product B and was subjected to heat curing, followed by cutting of the PFA tube at longitudinal end portions of obtain a pressing roller I having a longitudinal length of 320 mm (FIG. 4(*c*)). Incidentally, separately, the high thermal conductive elastic layer 24*b* was formed on the elastic layer-formed product A in the same molding manner as that described above. When a part of the high thermal conductive elastic layer 24*b* was cut away and was subjected to the measurement of the thermal conductivity by the above-described method, the thermal conductivity with respect to y-direction (longitudinal direction) was 31.7 W/(m·k) and the thermal conductivity with respect to x-direction was 13.4 W/(m·k).

Embodiment 2

The surface stock liquid was obtained by the same method as in Embodiment 1. A silicone rubber composition 2 was obtained by uniformly mixing and kneading 23.75 vol. % of the pitch-based carbon fiber (100-15M) and 1.25 vol. % of the carbon nanofiber (VGCF-S) per the total of the amount of the silicone rubber stock liquid and the total filler amount. Then, by using the same molding method as in Embodiment 1, a pressing roller II was obtained. Incidentally, separately, the high thermal conductive elastic layer 24*b* was formed on the elastic layer-formed product A in the same molding method as that described above. When a part of the high thermal conductive elastic layer 24*b* was cut away and was subjected to the measurement of the thermal conductivity by the above-described method, the thermal conductivity with respect to y-direction (longitudinal direction) was 34.0 W/(m·K) and the thermal conductivity with respect to x-direction was 14.5 W/(m·K).

Embodiment 3

The surface stock liquid was obtained by the same method as in Embodiment 1. A silicone rubber composition 3 was obtained by uniformly mixing and kneading 23 vol. % of the pitch-based carbon fiber (100-15M) and 2 vol. % of the carbon nanofiber (VGCF-S) per the total of the amount of the silicone rubber stock liquid and the total filler amount. Then, by using the same molding method as in Embodiment 1, a pressing roller III was obtained. Incidentally, separately, the high thermal conductive elastic layer 24*b* was formed on the elastic layer-formed product A in the same molding method as that described above. When a part of the high thermal conductive elastic layer 24*b* was cut away and was subjected to the measurement of the thermal conductivity by the above-described method, the thermal conductivity with respect to y-direction (longitudinal direction) was 35.7 W/(m·K) and the thermal conductivity with respect to x-direction was 15.7 W/(m·K).

Embodiment 4

The surface stock liquid was obtained by the same method as in Embodiment 1. A silicone rubber composition 4 was obtained by uniformly mixing and kneading 20 vol. % of the pitch-based carbon fiber (100-15M) and 5 vol. % of the carbon nanofiber (VGCF-S) per the total of the amount of the silicone rubber stock liquid and the total filler amount. However, the silicone rubber composition 4 had a high viscosity, so that a processing problem such that it was difficult to inject the composition occurred and therefore a pressing roller IV was not able to be prepared.

Embodiment 5

In Embodiment 5, a pressing roller V was prepared by changing the total amount of the dispersed filler but the amount of the carbon nanofibers per the total filler amount was not changed.

The surface stock liquid was obtained by the same method as in Embodiment 1. A silicone rubber composition 5 was obtained by uniformly mixing and kneading 27.6 vol. % of the pitch-based carbon fiber (100-15M) and 2.4 vol. % of the carbon nanofiber (VGCF-S) per the total of the amount of the silicone rubber stock liquid and the total filler amount. Then, by using the same molding method as in Embodiment 1, the pressing roller V was obtained. Incidentally, separately, the high thermal conductive elastic layer 24*b* was formed on the elastic layer-formed product A in the same molding method as that described above. When a part of the high thermal conductive elastic layer 24*b* was cut away and was subjected to the measurement of the thermal conductivity by the above-described method, the thermal conductivity with respect to y-direction (longitudinal direction) was 40.2 W/(m·K) and the thermal conductivity with respect to x-direction was 21.4 W/(m·K).

Embodiment 6

Also in Embodiment 6, a pressing roller VI is prepared by changing the total amount of the dispersed filler but the amount of the carbon nanofibers per the total filler amount was not changed.

The surface stock liquid was obtained by the same method as in Embodiment 1. A silicone rubber composition 6 was obtained by uniformly mixing and kneading 32.2 vol. % of the pitch-based carbon fiber (100-15M) and 2.8 vol. % of the carbon nanofiber (VGCF-S) per the total of the amount of the silicone rubber stock liquid and the total filler amount. However, the silicone rubber composition 4 had a high viscosity, so that a processing problem such that it was difficult to inject the composition occurred and therefore the pressing roller VI was not able to be prepared.

Comparative Embodiment 1

A pressing roller VII was prepared by mixing only the carbon nanofibers in the silicone rubber stock liquid in order to compare its effect with those of the pressing rollers in Embodiments 1 to 6.

First, the surface stock liquid was obtained by the same method as in Embodiment 1. A silicone rubber composition 7 was obtained by uniformly mixing and kneading 25 vol. % of the pitch-based carbon fiber (100-15M) per the total of the amount of the silicone rubber stock liquid and the total filler amount. Then, by using the same molding method as in Embodiment 1, the pressing roller VII was obtained. Incidentally, separately, the high thermal conductive elastic layer 24*b* was formed on the elastic layer-formed product A in the same molding method as that described above. When a part of the high thermal conductive elastic layer 24*b* was cut away and was subjected to the measurement of the thermal conductivity by the above-described method, the thermal conductivity with respect to y-direction (longitudinal direction) was 27.5 W/(m·K) and the thermal conductivity with respect to x-direction was 11.9 W/(m·K).

Comparative Embodiment 2

A pressing roller VIII was prepared in order to check an effect thereof when another short fiber was used instead of the carbon nanofiber.

First, the surface stock liquid was obtained by the same method as in Embodiment 1. A silicone rubber composition 8 was obtained by uniformly mixing and kneading 23.75 vol. % of the pitch-based carbon fiber (100-15M) and 1.25 vol. % of pitch-based carbon fiber (100-05M) per the total of the amount of the silicone rubber stock liquid and the total filler amount. Then, by using the same molding method as in Embodiment 1, the pressing roller VIII was obtained. Incidentally, separately, the high thermal conductive elastic layer 24*b* was formed on the elastic layer-formed product A in the same molding method as that described above. When a part of the high thermal conductive elastic layer 24*b* was cut away and was subjected to the measurement of the thermal conductivity by the above-described method, the thermal conductivity with respect to y-direction (longitudinal direction) was 25.5 W/(m·K) and the thermal conductivity with respect to x-direction was 11.3 W/(m·K).

(Performance Evaluation of Each Pressing Roller in Embodiments 1, 2, 3 and 5 and Comparative Embodiments 1 and 2)

With respect to non-sheet-passing portion temperature rise, the performance evaluation was made by using the pressing rollers I, II, III, V, VII and VIII in Embodiments 1, 2, 3 and 5 and Comparative Embodiments 1 and 2, respectively, as the pressing roller 24 of the fixing device 6. In each of the fixing devices including the pressing rollers I, II, III, V, VI and VII, the peripheral speed (process speed) of each pressing roller was adjusted to 234 mm/sec and the fixing temperature was set at 220° C. In this state, a surface temperature of the fixing film 23 at the non-sheet-passing portion (i.e., an area of the heater 22 through which letter (LTR)-sized paper (landscape) did not pass) when sheets of the letter-sized paper were continuously passed through the fixing device 6 at a speed of 50 sheets/minute was measured.

A result of the performance evaluation was shown in Table 1 together with the compositions of the respective silicone rubbers.

In the fixing device including the pressing roller VII in Comparative Embodiment 1, the high thermal conductive elastic layer 24*b* has the thermal conductivity of 27.5 W/(m·K) with respect to y-direction and 11.9 W/(m·K) with respect to x-direction, the non-sheet-passing portion temperature is 266° C. Hereinafter, on the basis of the result of Comparative Embodiment 1, an effect with respect to the non-sheet-passing portion temperature rise is judged. Incidentally, at this time, the surface temperature of the fixing film 23 at the sheet passing portion (the area of the heater 22 through which the letter-sized paper (landscape) passed) of the letter-sized paper (landscape) was 205° C. The surface temperature of the fixing film 23 at the sheet passing portion was the same with respect to all the fixing devices including the pressing rollers I, II, III, VII and VIII, thus being omitted from description below.

In the fixing device including the pressing roller I in Embodiment 1, the high thermal conductive elastic layer had the thermal conductivity of 31.7 W/(m·K) with respect to y-direction and 13.4 W/(m·K) with respect to x-direction, so that it was possible to make the thermal conductivity with respect to y-direction higher than that in Comparative Embodiment 1 by mixing the carbon nanofiber. As a result, the non-sheet-passing portion temperature was 256° C., so that a sufficient temperature rise suppressing effect was achieved at the non-sheet-passing portion.

In the fixing device including the pressing roller II in Embodiment 2, the carbon nanofiber is mixed in a larger amount than that of the high thermal conductive elastic layer of the pressing roller I in Embodiment 1. Therefore, the high thermal conductive elastic layer had the thermal conductivity of 34.0 W/(m·K) with respect to y-direction and 14.5 W/(m·K) with respect to x-direction, so that it was possible to make the thermal conductivity with respect to y-direction higher than that in Comparative Embodiment 1. As a result, the non-sheet-passing portion temperature was 252° C., so that the sufficient temperature rise suppressing effect was achieved at the non-sheet-passing portion.

In the fixing device including the pressing roller III in Embodiment 3, the carbon nanofiber is mixed in a larger amount than that of the high thermal conductive elastic layer of the pressing roller I in Embodiment 2. Therefore, the high thermal conductive elastic layer had the thermal conductivity of 35.7 W/(m·K) with respect to y-direction and 15.7 W/(m·K) with respect to x-direction, so that it was possible to

TABLE 1

| | PRESING | | CARBON FIBER | | CARBON NANOFIBER | | | FD RUBBER*3 TC*4 (W/(m · k)) | | FILM SURFACE | |
|---|---|---|---|---|---|---|---|---|---|---|---|
| EMB. NO. | ROLLER No. | TFA*1 (vol %) | TYPE | CONTENT (vol %) | TYPE | CONTENT (vol %) | CPTFA*2 (vol %) | y | x | NSPPT*5 (° C.) | |
| EMB. 1 | I | 25 | 100-15M | 24.5 | VGCF-S | 0.5 | 2 | 31.7 | 13.4 | 256 | ◎ |
| EMB. 2 | II | 25 | 100-15M | 23.75 | VGCF-S | 1.25 | 5 | 34.0 | 14.5 | 252 | ◎ |
| EMB. 3 | III | 25 | 100-15M | 23 | VGCF-S | 2 | 8 | 35.7 | 15.7 | 249 | ◎ |
| EMB. 4 | IV | 25 | 100-15M | 20 | VGCF-S | 5 | 20 | — | — | — | — |
| EMB. 5 | V | 30 | 100-15M | 27.6 | VGCF-S | 2.4 | 8 | 40.2 | 21.4 | 242 | ◎ |
| EMB. 6 | VI | 35 | 100-15M | 32.2 | VGCF-S | 2.8 | 8 | — | — | — | — |
| COMP. EMB. 1 | VII | 25 | 100-15M | 25 | — | — | — | 27.5 | 11.9 | 266 | ○ |
| COMP. EMB. 2 | VIII | 25 | 100-15M | 23.75 | 100-05M | 1.25 | 5 | 25.5 | 11.3 | 270 | ○ |

*1"TFA" is a total filler amount.

*2"CPTFA" is a content per total filler amount.

*3"FD RUBBER" is a fiber-dispersed rubber.

*4"TC" is thermal conductivity.

*5"NSPPT" is a non-sheet passing portion temperature.

make the thermal conductivity with respect to y-direction higher than that in Comparative Embodiment 1. As a result, the non-sheet-passing portion temperature was 249° C., so that the sufficient temperature rise suppressing effect was achieved at the non-sheet-passing portion.

In Embodiment 4, as described above, the pressing roller IV as not able to be prepared due to the processing problem and therefore the evaluation was not effected.

In the fixing device including the pressing roller V in Embodiment 5, the total filler amount was larger than those in Embodiments 1 to 3. Therefore, the high thermal conductive elastic layer had the thermal conductivity of 40.2 W/(m·K) with respect to y-direction and 21.4 W/(m·K) with respect to x-direction, so that it was possible to make the thermal conductivity with respect to y-direction higher than that in Comparative Embodiment 1. As a result, the non-sheet-passing portion temperature was 242° C., so that the sufficient temperature rise suppressing effect was achieved at the non-sheet-passing portion.

In Embodiment 6, as described above, the pressing roller VI was not able to be prepared due to the processing problem and therefore the evaluation was not effected.

In the fixing device including the pressing roller VIII in Comparative Embodiment 2, the CF (100-05M) is mixed but is the short fiber having a shorter fiber length, thus failing to perform the function of connecting the carbon fibers with each other. Therefore, the high thermal conductive elastic layer has the thermal conductivity of 25.5 W/(m·K) with respect to y-direction and 11.3 W/(m·K) with respect to x-direction. For that reason, the non-sheet-passing portion temperature was 270° C., so that the temperature rise suppressing effect achieved as in Embodiments 1 to 3 and 5 was not obtained.

From the above-described results of Embodiments 1 to 6 and Comparative Embodiments 1 and 2, the upper limit of the carbon nanofibers 24*g* dispersed in the heat-resistant elastic material 24*e* may preferably be less than 20 vol. % with respect to the total filler amount (the sum of the amount of the carbon fibers 24*f* and the amount of the carbon nanofibers 24*g*). When the upper limit exceeds 20 vol. %, the viscosity of the silicone rubber composition for the high thermal conductive elastic layer 24*b* is increased, so that a problem on molding (processing) arises. Further, the upper limit of the total filler amount of the carbon fibers 24*f* and the carbon nanofibers 24*g* which are dispersed in the heat-resistant elastic material 24*e* may preferably be not more than 30 vol. %. When the upper limit exceeds 30 vol. %, the viscosity of the silicone rubber composition for the high thermal conductive elastic layer 24*b* is increased, so that the molding (processing) problem arises. The lower limit of the total filler amount may preferably be not less than 5 vol. %. When the lower limit is below 5 vol. %, the heat conductive performance is lowered, so that an expected value of a desired heat conductive performance cannot be obtained.

As described above, the heat conductive carbon fibers 24*f* and a small amount of the carbon nanofibers 24*g* are used in combination, so that the carbon nanofibers 24*g* perform the function of connecting the carbon fibers 24*f* with each other. As a result, the thermal conductivity of the high thermal conductive elastic layer with respect to the longitudinal direction of the pressing roller 24 can be made higher than that of the high thermal conductive elastic layer containing only the carbon fibers 24*f* without including the total amount of the filler dispersed in the high thermal conductive elastic layer. Therefore, by using the pressing rollers I, II, III and V in Embodiments 1, 2, 3 and 5 in the fixing device 6, the non-sheet-passing portion temperature rise can be alleviated compared with the fixing device using the pressing roller in which only the carbon fibers 24*f* are contained.

Other Embodiments (1) In the fixing device 6 in the above-described embodiments, the heat generating element 22 is not limited to the ceramic heather. For example, the heat generating element 22 may also be a contact heat generating element or the like using nichrome wire or the like, or an electromagnetic induction heat generating member or the like, such as a piece of iron plate or the like. The heat generating element 22 is not always located in the fixing nip (press-contact nip). It is also possible to prepare a heat fixing device of an electromagnetic-induction heating type in which the film 23 itself is constituted by an electromagnetic-induction heat generating metal film. It is also possible to employ a device constitution in which the film 23 is extended and stretched around a plurality of stretching members and is rotationally driven by a driving roller. Further, a device constitution in which the film 23 is an elongated member which is rolled around a feeding shaft and has an end and the film 23 is moved toward the feeding shaft side may also be employed.

(2) The fixing device in the Embodiments described above is not limited to the film-heating type but may also be a heating-roller type including a fixing roller as the heating member and a pressing roller as the pressing member which creates a nip therebetween in contact with the fixing roller.

(3) The fixing device is not limited to those in embodiments described above but may also be an image heating apparatus for temporarily fixing an unfixed image or an image heating apparatus for modifying a surface property such as gloss or the like by re-heating the recording material on which the image is carried.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 240324/2009 filed Oct. 19, 2009, which is hereby incorporated by reference.

What is claimed is:

1. A pressing member for creating a nip in which said pressing member contacts a heating member and a recording material is heated while being nip-conveyed, said pressing member comprising:

an elastic layer; and a high thermal conductive elastic layer which is provided on said elastic layer and has a thermal conductivity which is higher than that of said elastic layer, wherein in said high thermal conductive elastic layer, carbon fibers and carbon nanofibers are dispersed, wherein the carbon fibers have an average fiber length of not less than 0.05 mm and not more than 1 mm, wherein the carbon nanofibers have an average fiber length of not more than 20 μm.

2. A pressing member according to claim 1, wherein the carbon fibers have a thermal conductivity $\lambda_f$ satisfying: $\lambda_f \geqq 500$ W/(m·k), and wherein the carbon nanofibers have an average fiber diameter of not less than 50 nm and less than 1 μm, and an aspect ratio (fiber length/fiber diameter) of not less than 20.

3. A pressing member according to claim 1, wherein the carbon fibers and the carbon nanofibers are dispersed in the thermal conductive elastic material in a total amount of not less than 5 vol. % and not more than 30 vol. %.

4. A pressing member according to claim 3, wherein the carbon nanofibers are dispersed in the thermal conductive elastic layer in an amount of less than 20 vol. % with respect to a total amount of the carbon fibers and the carbon nanofibers.

5. An image heating apparatus comprising:

a heating member; and a pressing member, including an elastic layer and a high thermal conductive elastic layer which is provided on said elastic layer and has a thermal conductivity which is higher than that of said elastic layer, for creating a nip in contact with said heating member, wherein in the high thermal conductive elastic layer, carbon fibers and carbon nanofibers are dispersed wherein the carbon fibers have an average fiber length of not less than 0.05 mm and not more than 1 mm, and wherein the carbon nanofibers have an average fiber length of not more than 20 μm.

6. An image heating apparatus according to claim 5, wherein the carbon fibers have a thermal conductivity $\lambda_f$ satisfying: $\lambda_f \geqq 500$ W/(m·k), and wherein the carbon nanofibers have an average fiber diameter of not less than 50 nm and less than 1 μm, and an aspect ratio (fiber length/fiber diameter) of not less than 20.

7. An image heating apparatus according to claim 5, wherein the carbon fibers and the carbon nanofibers are dispersed in the thermal conductive elastic layer in a total amount of not less than 5 vol. % and not more than 30 vol. %.

8. An image heating apparatus according to claim 7, wherein the carbon nanofibers are dispersed in the thermal conductive elastic layer in an amount of less than 20 vol. % with respect to a total amount of the carbon fibers and the carbon nanofibers.

9. A pressing member according to claim 4, wherein a total thickness of the elastic layer and the thermal conductive elastic layer is not less than 2 mm and not more than 10 mm.

10. A pressing member according to claim 4, wherein a thermal conductivity of the thermal conductive elastic layer with respect to a longitudinal direction of the pressing member is not less than 31.7 W/(m·k).

11. An image heating apparatus according to claim 8, wherein a total thickness of the elastic layer and the thermal conductive elastic layer is not less than 2 mm and not more than 10 mm.

12. An image heating apparatus according to claim 8, wherein a thermal conductivity of the thermal conductive elastic layer with respect to a longitudinal direction of the pressing member is not less than 31.7 W/(m·k).

13. An image heating apparatus according to claim 5, wherein the heating member includes an endless belt.

14. An image heating apparatus according to claim 13, further comprising a heater for heating the endless belt, wherein the heater contacts with an inner surface of the endless belt.

* * * * *